US009637262B2

(12) United States Patent
Pedretti et al.

(10) Patent No.: US 9,637,262 B2
(45) Date of Patent: May 2, 2017

(54) FOLDING UNIT FOR POURABLE FOOD PRODUCT PACKAGING MACHINES

(75) Inventors: Richard Pedretti, Casinalbo di Formigine (IT); Massimo Pradelli, Reggio Emilia (IT); Fabrizio Rimondi, Castel San Pietro Terme (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 583 days.

(21) Appl. No.: 14/127,505

(22) PCT Filed: Sep. 5, 2012

(86) PCT No.: PCT/EP2012/067242
§ 371 (c)(1),
(2), (4) Date: Dec. 19, 2013

(87) PCT Pub. No.: WO2013/064288
PCT Pub. Date: May 10, 2013

(65) Prior Publication Data

US 2014/0228193 A1 Aug. 14, 2014

(30) Foreign Application Priority Data

Oct. 31, 2011 (EP) ..... 11187355

(51) Int. Cl.
*B65B 61/24* (2006.01)
*B65B 49/02* (2006.01)
(Continued)

(52) U.S. Cl.
CPC ..... *B65B 61/24* (2013.01); *B65B 49/02* (2013.01); *B65B 49/08* (2013.01); *B65B 49/14* (2013.01); *B65B 9/20* (2013.01)

(58) Field of Classification Search
CPC ..... B65B 49/02; B65B 49/08; B65B 49/14; B65B 61/24; B65B 9/20
(Continued)

(56) References Cited

U.S. PATENT DOCUMENTS 4,510,732 A 4/1985 Lothman
4,941,755 A 7/1990 Cazes
(Continued)

FOREIGN PATENT DOCUMENTS

CN 1441744 A 9/2003
CN 201105816 Y 8/2008
(Continued)

OTHER PUBLICATIONS

Office Action issued on Aug. 8, 2014, by the State Intellectual Property Office of People's Republic China in corresponding Chinese Patent Application No. 201280032846.2, and an English Translation of the Office Action. (14 pages).
(Continued)

*Primary Examiner* — Michelle Lopez
*Assistant Examiner* — Chinyere Rushing-Tucker
(74) *Attorney, Agent, or Firm* — Buchanan Ingersoll & Rooney PC

(57) ABSTRACT

A folding unit for producing packages of pourable food products from sealed packs having each a main portion and opposite end portions arranged on opposite sides of the main portion; each pack comprises a fin and a pair of flaps projecting laterally from main portion; a first movable conveying member fed with a plurality of packs and which feeds the pack along a forming path; and folder which interacts with each pack along forming path to fold relative first end fin onto the portion; the folder comprising: a first member movable along forming path together with the conveying member and defining a slot receiving, in use, end
(Continued)

fin; and a second member movable relative to first member between a first position in which it engages at least partially slot, so as to fold end fin onto a relative end portion, and a second position in which it leaves free slot.

19 Claims, 15 Drawing Sheets

(51) Int. Cl.
*B65B 49/08* (2006.01)
*B65B 49/14* (2006.01)
*B65B 9/20* (2012.01)

(58) Field of Classification Search
USPC ..... 493/180
See application file for complete search history.

(56) References Cited

U.S. PATENT DOCUMENTS 5,261,520 A 11/1993 Duke
5,894,710 A * 4/1999 Balder ..... B65B 49/08 53/398
5,966,899 A 10/1999 Fontanazzi
6,385,950 B1 * 5/2002 Anderson ..... B31B 1/52 493/164
2003/0146271 A1 8/2003 Furini et al.
2009/0005227 A1 1/2009 Rimondi et al.
2009/0113848 A1 * 5/2009 Santi ..... B65B 7/18 53/374.7
2009/0193763 A1 8/2009 Fontanazzi et al.
2012/0245008 A1 * 9/2012 Florentzson ..... B65B 61/24 493/162
2014/0131173 A1 * 5/2014 Pedretti ..... B65B 43/52 198/626.1
2014/0194267 A1 * 7/2014 Pradelli ..... B65B 49/04 493/243
2014/0196417 A1 * 7/2014 Galata' ..... B65B 61/24 53/551
2014/0223858 A1 * 8/2014 Pedretti ..... B65B 35/58 53/203
2014/0228193 A1 * 8/2014 Pradelli ..... B65B 49/02 493/180
2014/0371046 A1 * 12/2014 Catellani ..... B31B 3/02 493/162
2015/0344163 A1 * 12/2015 Santi ..... B65B 61/24 53/375.7

FOREIGN PATENT DOCUMENTS

CN 101395062 A 3/2009
EP 0 279 762 A1 8/1988
EP 1 726 526 A1 11/2006
EP 1 826 126 A1 8/2007
EP 2 284 084 A1 2/2011
GB 1016924 1/1966
JP 2008-540280 A 11/2008
JP 2010-168071 A 8/2010

OTHER PUBLICATIONS

International Search Report (PCT/ISA/210) mailed on Dec. 7, 2012, by the European Patent Office as the International Searching Authority for International Application No. PCT/EP2012/067242.
Office Action issued on Aug. 8, 2016, by the Japanese Patent Office, in corresponding Japanese Patent Application No. 2014-537530, and an English language translation of the Office Action (5 pages).
U.S. Appl. No. 14/127,503, filed Feb. 11, 2014, Pradelli.
U.S. Appl. No. 14/127,613, filed Jan. 24, 2014, Pedretti et al.
U.S. Appl. No. 14/127,586, filed Jan. 24, 2014, Galata.
U.S. Appl. No. 14/127,506, filed Jan. 22, 2014, Pedretti et al.
U.S. Appl. No. 14/127,520, filed Jan. 22, 2014, Pedretti et al.

* cited by examiner

FOLDING UNIT FOR POURABLE FOOD PRODUCT PACKAGING MACHINES

TECHNICAL FIELD

The present invention relates to a folding unit for producing folded packages of pourable food products from relative sealed packs.

BACKGROUND ART

As is known, many food products, such as fruit juice, pasteurized or UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated strip packaging material.

The packaging material has a multilayer structure substantially comprising a base layer for stiffness and strength, which may comprise a layer of fibrous material, e.g. paper, or of mineral-filled polypropylene material; and a number of layers of heat-seal plastic material, e.g. polyethylene film, covering both sides of the base layer.

In the case of aseptic packages for long-storage products, such as UHT milk, the packaging material may also comprise a layer of gas- and light-barrier material, e.g. an aluminium foil or an ethyl vinyl alcohol (EVOH) foil, which is superimposed on a layer of heat-seal plastic material, and is in turn covered with another layer of heat-seal plastic material forming the inner face of the package eventually contacting the food product.

As is known, packages of this sort are produced on fully automatic packaging machines, on which a continuous tube is formed from the web-fed packaging material. The web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating. The web of packaging material so sterilized is maintained in a closed, sterile environment, and is folded and sealed longitudinally to form a vertical tube.

The tube is filled continuously downwards with the sterilized or sterile-processed food product, and is sealed and then cut along equally spaced cross sections to form pillow packs, which may be fed to a folding unit to form the finished packages.

More specifically, the pillow packs substantially comprise a main portion, and opposite top and bottom end portions tapering from the main portions towards respective top and bottom sealing bands which extends substantially orthogonal to the axis of the pack. In detail, each end portion is defined by a pair of respective trapezoidal walls which extend between main portion of the pack and the relative sealing fin.

Each pillow pack also comprises, for each top and bottom end portion, an elongated substantially rectangular fin projecting from respective sealing band; and a pair of substantially triangular flaps projecting from opposite sides of relative end portion and defined by respective trapezoidal walls.

The end portions are pressed towards each other by the folding unit to form flat opposite end walls of the pack, while at the same time folding the flaps of the top portion onto respective lateral walls of the main portion and the flaps of the bottom portion onto the bottom sealing band.

Packaging machines for producing packages of the above type are known, typically comprising:

- an in-feed conveyor;
- a folding unit receiving the pillow packs from the in-feed conveyor and adapted to fold these pillow packs to form the parallelepiped-shaped packages;
- a transfer unit for transferring and up-ending sealed folded packages, which is arranged downstream from the folding unit and receives the sealed packages from the folding unit; and
- an out-feed conveyor which receives folded packages from the transfer unit and moves them away from the packaging machine.

Folding units are known, for example from EP-A-2284084 in the name of the same Applicant, which typically comprise:

- a chain conveyor for feeding packs continuously along a forming path from a supply station to an output station; and
- first and second folding means, which cooperate cyclically, which each pack to flatten respective end portions of each pack and so fold respective fins onto end portions.

In detail, the first folding means comprise a fixed guide member, which is positioned facing and at a distance from a conveying portion of the chain, and converge towards this conveying portion. The fixed guide member cooperates with bottom end portion of each pack to press it down flat towards the chain.

The second folding means comprise:

- a plurality of movable plates hinged to relative links of the chain about relative axes crosswise to the forming path; and
- a plurality of cams carried by the conveyor chain and each cooperating, in use, with a relative movable plate.

In detail, each plate defines a surface adapted to cooperate with a top fin of relative pack. Upon impact with fin, each plate moves from a rest position to a first operative position in which relative surface defines a first angle of over 90 degrees with the axis of the relative pack.

As moving along forming path, each plate moves towards a second operative position in which the relative surface defines a second angle lower than the first angle with the axis of relative package. Accordingly, a central portion of the top fin is folded towards main portion of relative pack.

The second folding means comprise a pair of wheels supported by a fixed structure of folding unit, and a pair of rails converging towards guide member. Each rail comprises a relative first portion arranged below respective wheels and a relative second portion. In detail, the second portions are arranged downstream from first portions, proceeding according to the advancing direction of packs along forming path.

The wheels and the first portions of relative rails define respective passages through which lateral zones of the top fin cyclically pass. In this way, lateral zones are partially folded onto main portion of pack.

As they slide onto second portions of rails, lateral zones are completely folded onto main portion of pack.

Though efficient, packaging machines of the above type leave room for improvement.

In particular, the central portion of the top fin is folded by a relative movable plate whereas the lateral portions are folded by the wheels and the rails.

Furthermore, the top end is folded onto the main portion of the relative packs in two subsequent steps. The first step is carried out by the relative movable plate and by the wheels and the first portions of rails while the second step is carried out by the second portions of rails.

A need is felt within the industry to render as precise and repeatable as possible, the folding of the top end fin onto the main portion of packs.

Furthermore, in the known folding unit, the second folding means completely fold the top flaps of the top end onto the main portion.

The top flaps are therefore pressed onto the main portion of the formed package by a pressure device which is arranged downstream from the first folding means and is shown in EP-B-0887261 and which substantially comprises three endless belts fixed relative to the conveyor chain.

Accordingly, the forming of the packages is substantially controlled by the pressure device which defines with the chain conveyor a forming passage having a constant rectangular section, and defining the outer contour of the finished packages.

However, a wide range of modified package shapes has been developed which are different from the parallelepiped package.

In particular, packages with a slightly rounded or an octagonal cross section have been developed.

For these packages, the Applicant has found that the forming operation may require some adjustments.

This is mainly due to the fact that the forming passage must be, in this case, polygonal whereas the endless belts have substantially flat surfaces cooperating with the folded package.

DISCLOSURE OF INVENTION

It is an object of the present invention to provide a folding unit for a pourable food product machine, designed to provide a straightforward, low-cost solution to meet at least one of the above need, typically associated with the known folding unit.

According to the present invention, there is provided a folding unit for producing folded packages of pourable food products from relative sealed packs, as claimed in claim 1.

BRIEF DESCRIPTION OF THE DRAWINGS

A preferred, non-limiting embodiment of the present invention will be described by way of example with reference to the accompanying drawings, in which:

FIG. 15 shows in a perspective enlarged view a pack the folding unit of FIGS. 1 to 14 is fed with.

BEST MODE FOR CARRYING OUT THE INVENTION

Figure 1:
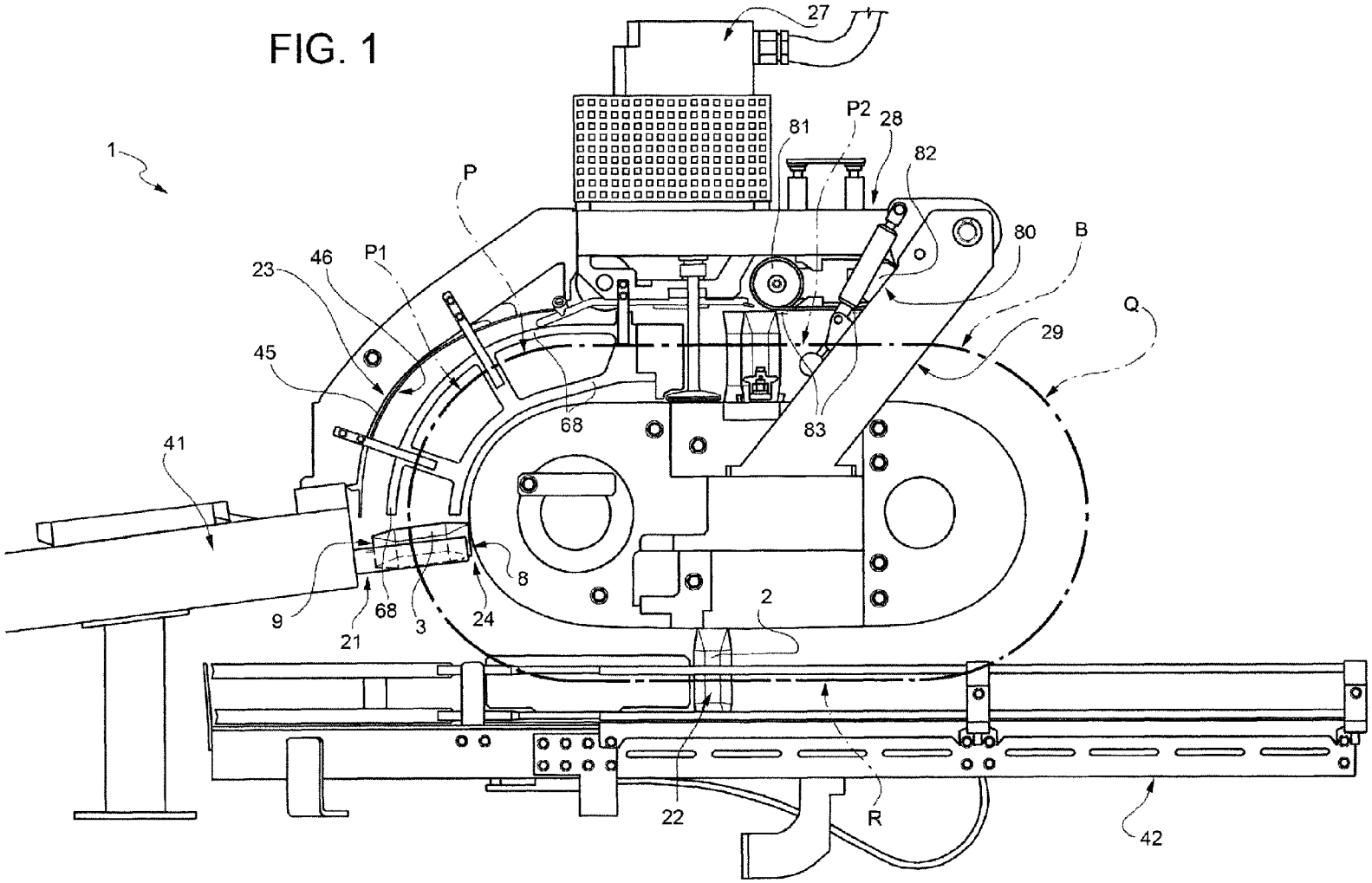
FIG. 1 shows a side view, with parts removed for clarity, of a folding unit in accordance with the present invention for producing folded packages of pourable food products from sealed pillow packs.

Number 1 in FIG. 1 indicates as a whole a folding unit for a packaging machine (not shown) for continuously producing sealed packages 2 of a pourable food product, such as pasteurized or UHT milk, fruit juice, wine, etc., from a known tube of packaging material (not shown).

The tube is formed in known manner upstream from unit 1 by longitudinally folding and sealing a known web (not shown) of heat-seal sheet material which may comprise a base layer for stiffness and strength, which may be formed by a layer of fibrous material, e.g. paper, or of mineral-filled polypropylene material, and a number of layers of heat-seal plastic material, e.g. polyethylene film, covering both sides of the base layer. In the case of an aseptic package for long-storage products, such as UHT milk, the packaging material may also comprises a layer of gas- and light-barrier material, e.g. an aluminium foil or an ethyl vinyl alcohol (EVOH) foil, which is superimposed on a layer of heat-seal plastic material, and is in turn covered with another layer of heat-seal plastic material forming the inner face of the package 2 eventually contacting the food product.

The tube of packaging material is then filled with the food product for packaging, and is sealed and cut along equally spaced cross sections to form a number of pillow packs 3 (FIG. 15), which are then transferred to unit 1 where they are folded mechanically to form respective packages 2.

Alternatively, the packaging material may be cut into blanks, which are formed into packages 2 with forming spindles, and packages 2 are filled with the food product and sealed. One example of this type of package is the so-called "gable-top" package known by the trade name Tetra Rex (registered trademark).

In detail, pillow packs 3 are transferred to unit 1 by using an in-feed conveyor 41 (FIG. 1), which is described in more detail in the European application "Feeding unit and method for feeding sealed pillow packs of pourable food products to a folding unit", filed by the Applicant concurrently with the present invention.

Unit 1 also feeds folded package 2 to out-feed conveyor 42, shown in FIG. 1.

Figure 15:
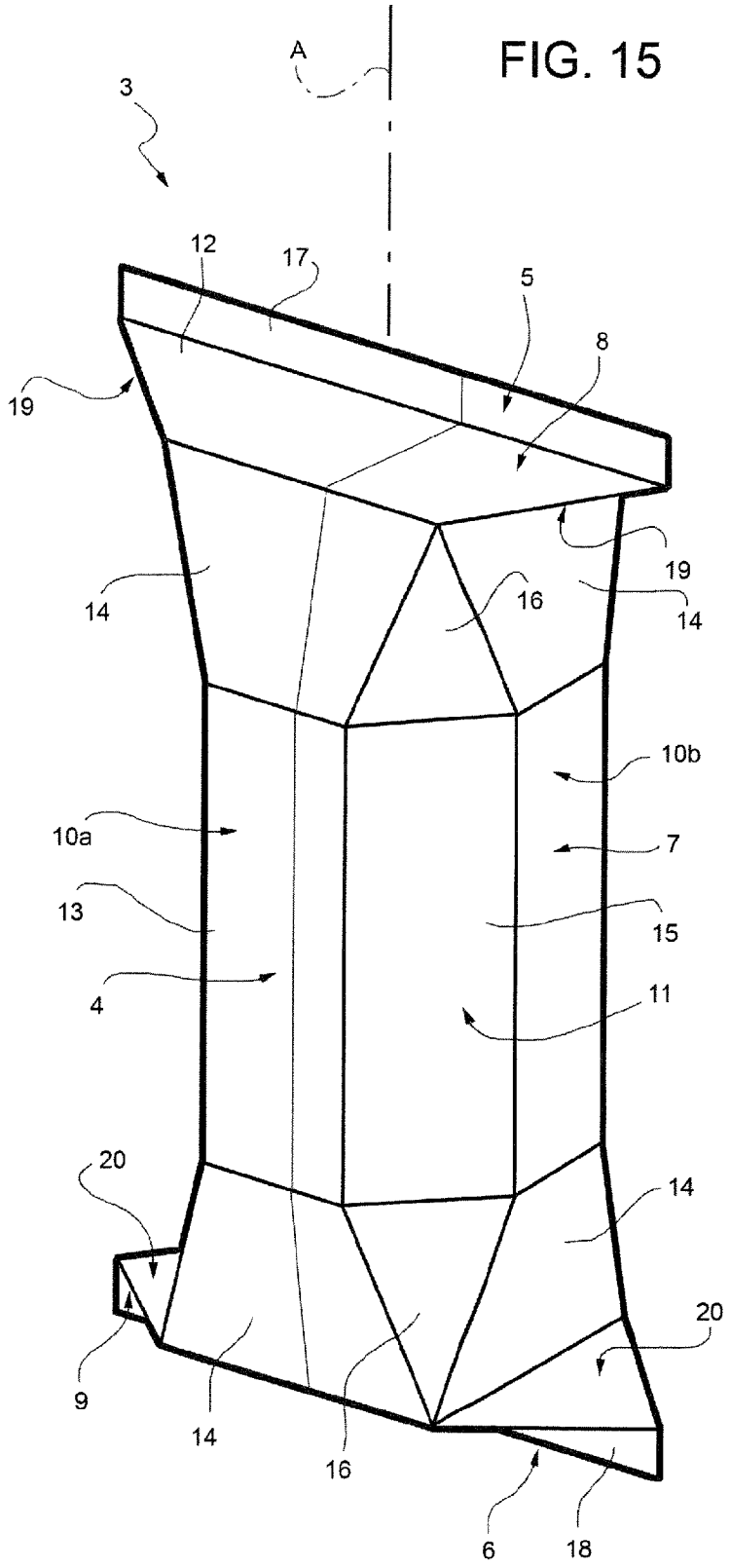

With reference to FIG. 15, an embodiment of a package 2 is shown which has a longitudinal sealing band 4, formed to produce the tube of packaging material from the web folded into a cylinder, extends along one side of each pack 3, which is closed at the opposite ends by respective transverse sealing bands 5, 6 perpendicular to and joined to longitudinal sealing band 4.

Each pack 3 has an axis A, and comprises a main body 7 and opposite, respectively top and bottom, end portions 8, 9 tapering from main body 7 towards respective transverse sealing bands 5, 6.

Main body 7 of each pack 3 is bounded laterally by four lateral walls 10*a*, 10*b* and four corner walls 11 alternate to each other, in the embodiment shown in FIG. 15.

Walls 10*a* (10*b*) are opposite to each other. In the very same way, walls 11 are opposite, in pairs, to each other.

Each wall 10*a*, 10*b* comprises a central rectangular stretch 13 and a pair of opposite, respective top and bottom, end stretches 14 which are interposed between stretch 13 and end portions 8, 9 of pack 3.

In detail, stretches 13 are substantially parallel to axis A. Each end stretch 14 is substantially in the form of an isosceles trapezium, which slopes slightly relative to axis A, and has a major edge defined by respective end portions 8, 9.

Each wall 11 comprises a central rectangular stretch 15 and a pair opposite, respective top and bottom end stretches 16 which are interposed between stretch 15 and end portions 8, 9 of pack 3.

In detail, stretches 15 are substantially parallel to axis A. Each end stretch 16 is substantially in the form of an isosceles triangle, which slopes slightly relative to axis A and which converges from relative stretch 15 towards corresponding end portions 8, 9.

Each end portion 8, 9 is defined by two walls 12, each substantially in the form of an isosceles trapezium, which slope slightly towards each other with respect to a plane perpendicular to axis A, and have minor edges defined by respective end edges of portions 14 of respective wall 10*a*, and major edges joined to each other by respective sealing bands 5, 6.

Longitudinal sealing band 4 extends between transverse sealing bands 5 and 6, and along the whole of one wall 10*a* and the corresponding walls 12 on the same side as wall 10*a*.

Each pack 3 also comprises, for each end portion 8, 9, a respective substantially elongated rectangular end fin 17, 18 projecting in the direction of axis A from relative pack 3; and two substantially triangular flaps 19, 20 projecting laterally on opposite sides of main body 7 and defined by end portions of relative walls 12.

More precisely, each end fin 17, 18 extends along a direction orthogonal to axis A.

To form a package 2, unit 1 presses end portions 8, 9 of relative pack 3 down flat towards each other, and at the same time folds respective fins 17, 18 onto end portions 8, 9.

Furthermore, unit 1 folds flaps 20 onto top stretches 14 of respective walls 10*b* and folds flaps onto previously folded fin 17, on the opposite side of end portion 9.

Figure 2:
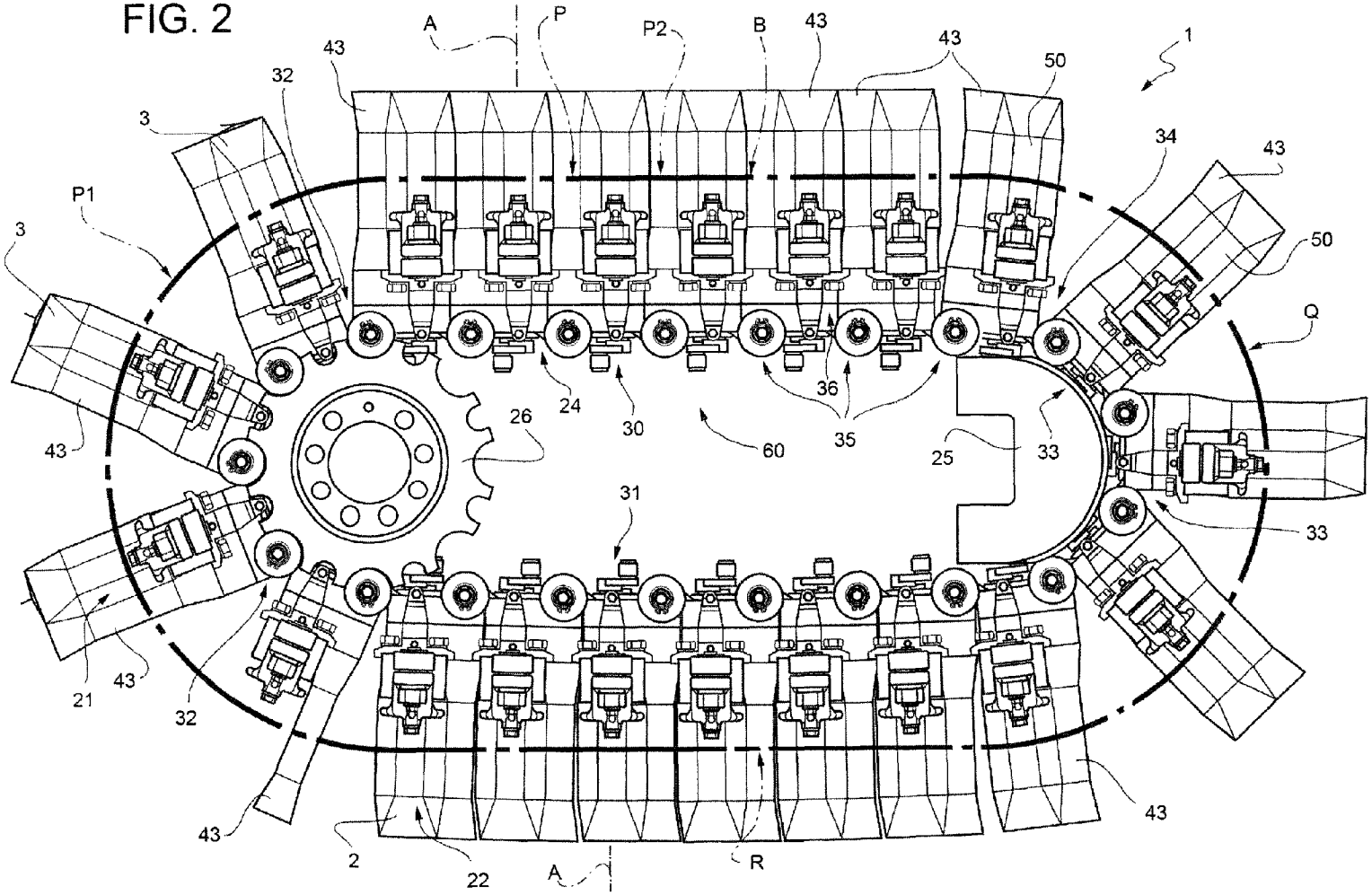
FIG. 2 is an enlarged side view of the folding unit of FIG. 1, with parts removed for clarity.

With reference to FIGS. 1, 2 and 15, unit 1 substantially comprises:

- a frame 29;
- an endless conveyor 34 for feeding packs 3 continuously along a forming path B from a supply station 21 to an output station 22 (both shown only schematically);
- folding means 23 which cooperate cyclically with each pack 3 to flatten end portion 8, fold relative fin 17 onto end portion 8, and fold flaps 19 onto previously flattened end portion 8 on the opposite side of end portion 9;
- folding means 24 for flattening end portion 9, folding relative fin 18 onto portion 9 and bending flaps 20 towards axis A and end portion 9;
- a heating device 27 acting on bent flaps 19, to melt the external layer of the packaging material and seal the flaps 19, 20 before they are pressed against end portion 8 and relative walls 10*b* respectively; and
- a pressing device 28 cooperating with each pack 3 to hold flaps 19 onto flattened fin 17 as flaps 19 cool.

Heating device 27 is, in particular, arranged between folding means 23 and pressure device 28 along forming path B.

With particular reference to FIGS. 2, 4, 5 and 6, conveyor 34 basically comprises an endless transport element, in the example shown a chain 60, formed by a plurality of mutually hinged rigid modules or links 35 and looped about a pair of coaxial driving sprockets 26 and a cam 25.

Chain 60 comprises a straight horizontal top branch 30, a bottom branch 31 substantially parallel to branch 30, and two curved C-shaped portions 32, 33, which are positioned with their concavities facing each other and connect branches 30 and 31; more specifically, C-shaped portion 32 cooperates with driving sprockets 26, whilst C-shaped portion 33 cooperates with cam 25.

Each link 35 comprises a substantially flat plate 36 adapted to receive a relative pack 3, and a paddle 43, which projects perpendicularly from plate 36 on the opposite side of driving sprockets 26 and cam 25 and which cooperates with and pushes a corresponding wall 10 of a relative pack 3 to feed it along path B.

Cam 25 is described in more detail in the European application "Folding unit for producing folded packages of pourable food products from relative sealed packs", filed by the Applicant concurrently with the present invention.

Unit 1 comprises (FIGS. 5 and 6) a plurality of pairs of shells 50 which are integrally movable along path B and are movable along a direction C transversal to path B; shells 50 of each pair may be arranged in:

- a fully closed position in which they exert a pressure onto a relative pack 3, so as to complete a folding operation thereon; and
- an open position in which they are detached from folded package 2.

Furthermore, shells 50 may be arranged also in a closed position, in which they grip folded package 2 but substantially do not exert any pressure thereon.

In detail, station 21 is defined by C-shaped portion 32 and station 22 is defined by bottom branch 31 in a position closer to C-shaped portion 32 than to C-shaped portion 33.

Path B comprises (FIG. 2), proceeding from station 21 to station 22:

- a portion P starting from station 21, comprising a curved stretch P1 and a straight stretches P2, along which packs 3 are folded into relative packages 2;
- a curved portion Q along which folded packages 2 are overturned of 180 degrees; and
- a straight portion R arranged downstream from curved portion Q and upstream from station 22.

In detail, stretch P1 is defined by a part of C-shaped portion 32 and stretch P2 is defined by top branch 30 of chain 60. Portion Q is defined by C-shaped portion 33, and portion R is defined by part of bottom branch 31 of chain 60.

Folding means 23 cooperate cyclically with each pack 3 along portion P.

Folding means 24 are defined by links 35 and, therefore, move together with chain 60 along path B.

Figure 8:
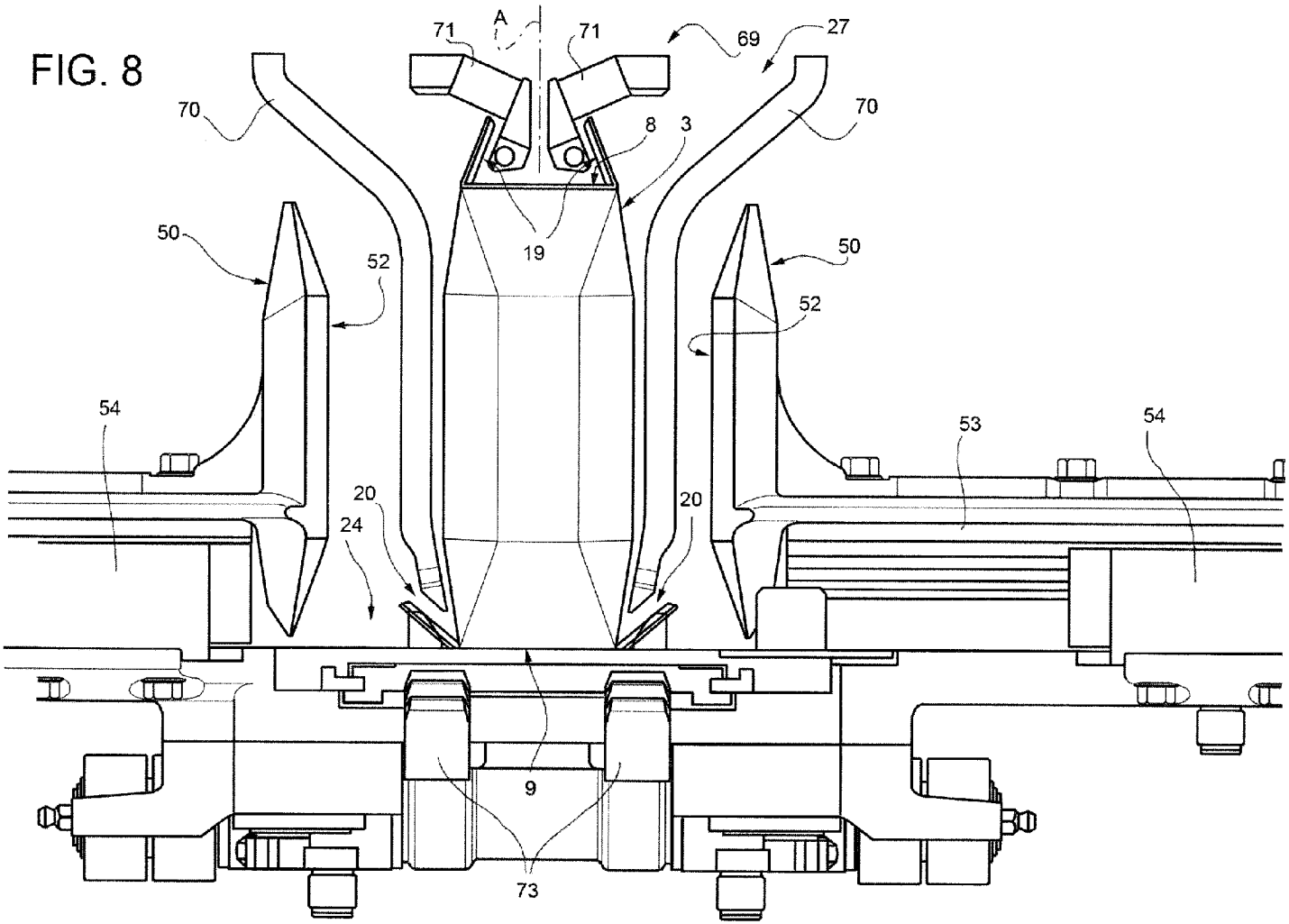

In detail, folding means 24 flatten end portion 9, folds relative fin 18 onto portion 9 and bend flaps 20 towards axis A and end portion 8, as relative pack 2 is carried along stretch P1 of path P (FIG. 8).

Figure 9:
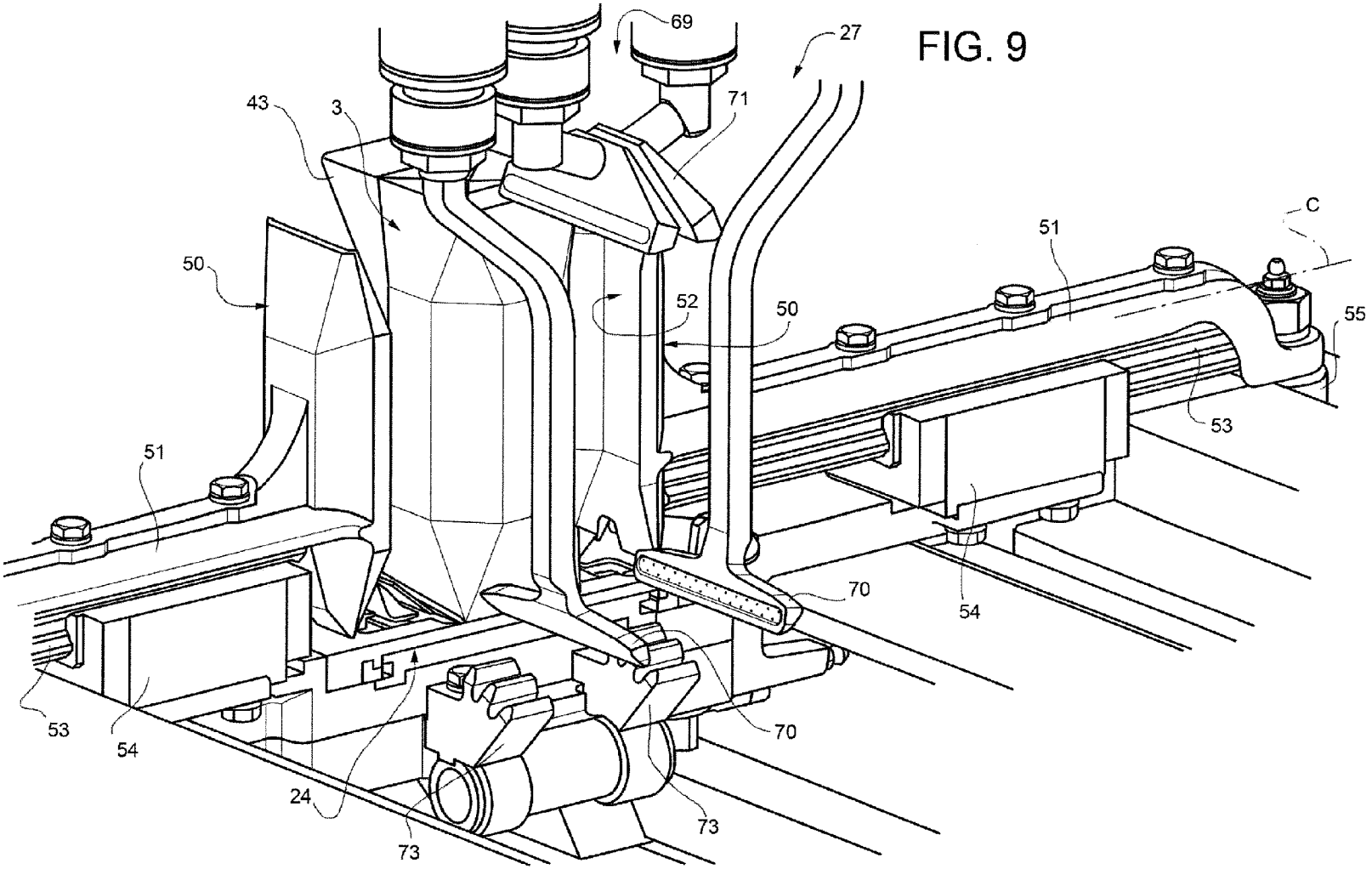
Figure 10:
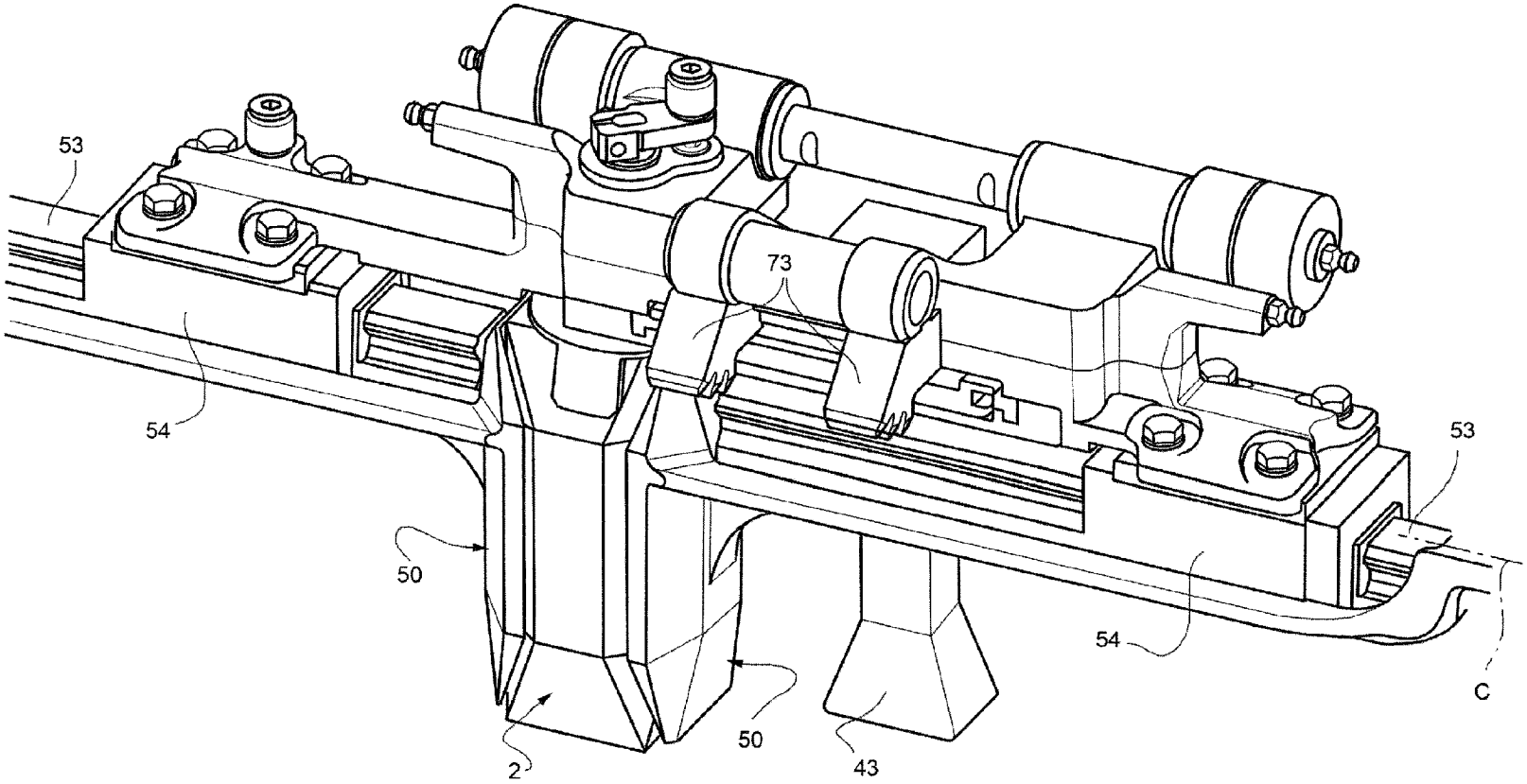

Heating device 27 acts on bent flaps 19, 20 to melt the external layer of the packaging material and seal the flaps 19, 20 before they are pressed against end portion 8 and relative walls 10*b* respectively, as pack 2 is carried along stretch P2 of portion P (FIG. 9).

In detail, shells 50 of each pair cyclically move according to the following work cycle.

Shells 50 of each pair are arranged in the open position at station 21, move from the open position to the fully closed position along stretch P1 and an initial part of stretch P2, and reach the fully closed position along a remaining part of stretch P2. In the embodiment shown, shells 50 reach the fully closed position downstream from heating device 27 and upstream from pressing device 28, proceeding according to the advancing direction of chain 60.

When shells 50 are arranged into the fully closed position they exert a certain pressure on relative walls 10*b* and 11 adjacent thereto.

More precisely, as moving between the open and the fully closed position along stretch P2 of portion P, shells 50 of each link 35 perform two functions:

firstly, they complete the bending of flaps 20 onto top stretches 14 of relative walls 10*b*; and then, they press flaps 20, which have been previously bent and heated, onto stretches 14 of relative walls 10*b*.

Furthermore, shells 50 of each pair move from the fully closed position into the closed position at the beginning of portion Q.

Figure 6:
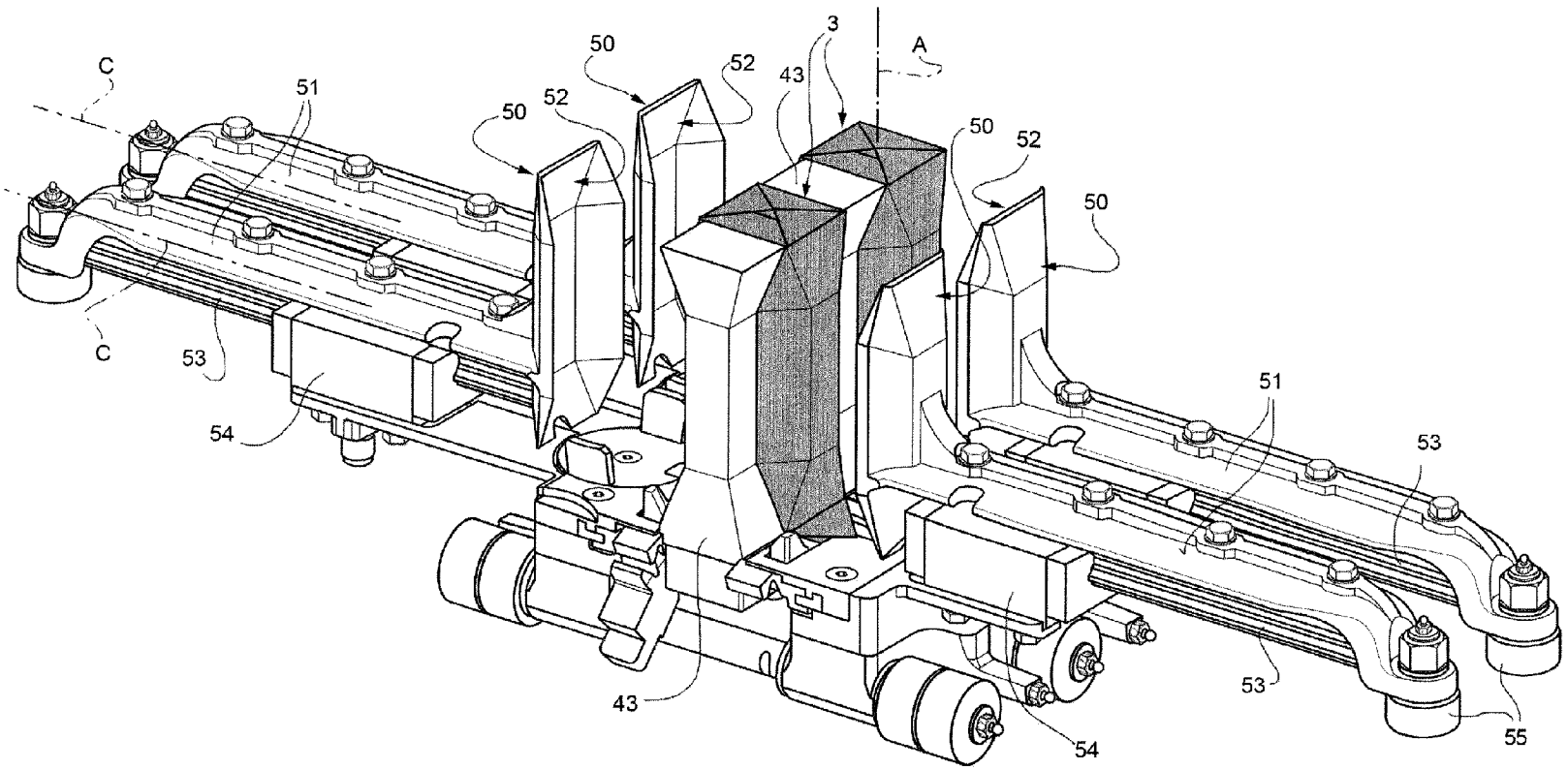
FIGS. 6 to 10 show some components of the unit of FIGS. 1 to 5 in different operative conditions.
Figure 7:
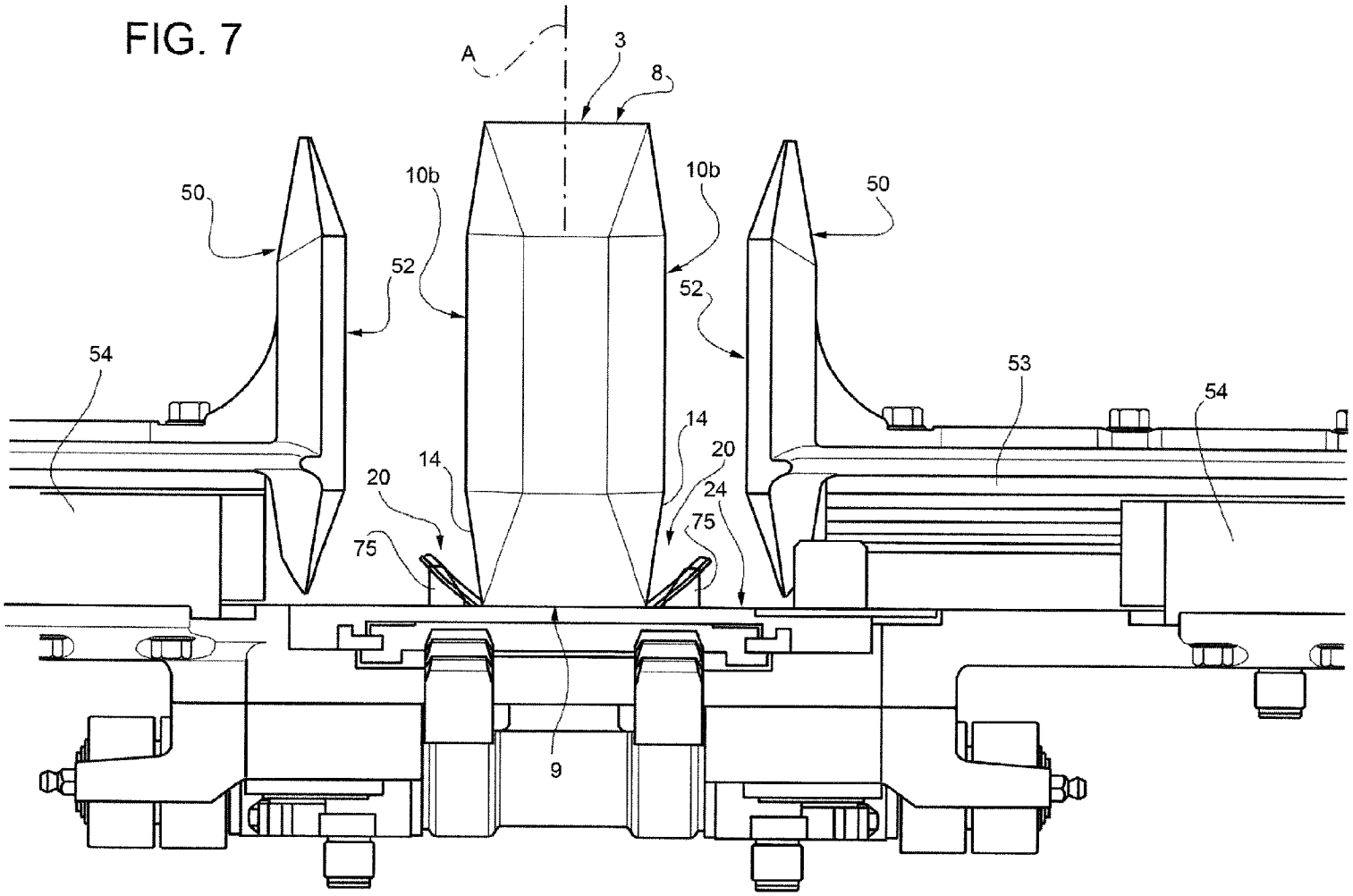

Along portion Q, shells 50 integrally move parallel to direction C and relative to respective paddle 43 (FIG. 6).

In the embodiment shown, shells move away relative to each other for a distance, for example, of 2-4 mm, when they move from the fully closed to the closed position.

In the following of the present description, only one link 35 will be described in detail, being clear that all links 35 are identical to each other.

Figure 13:
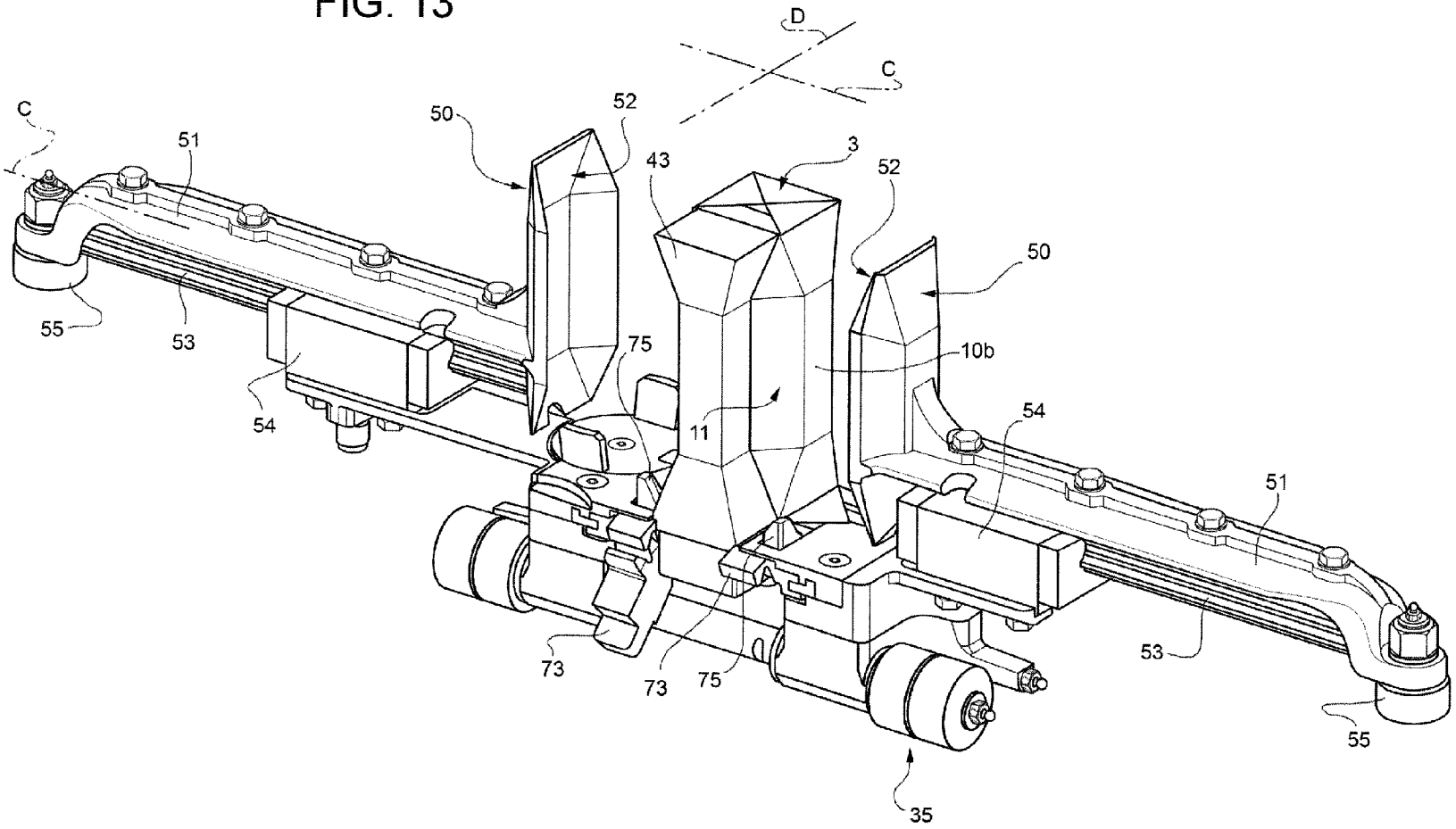
Figure 14:
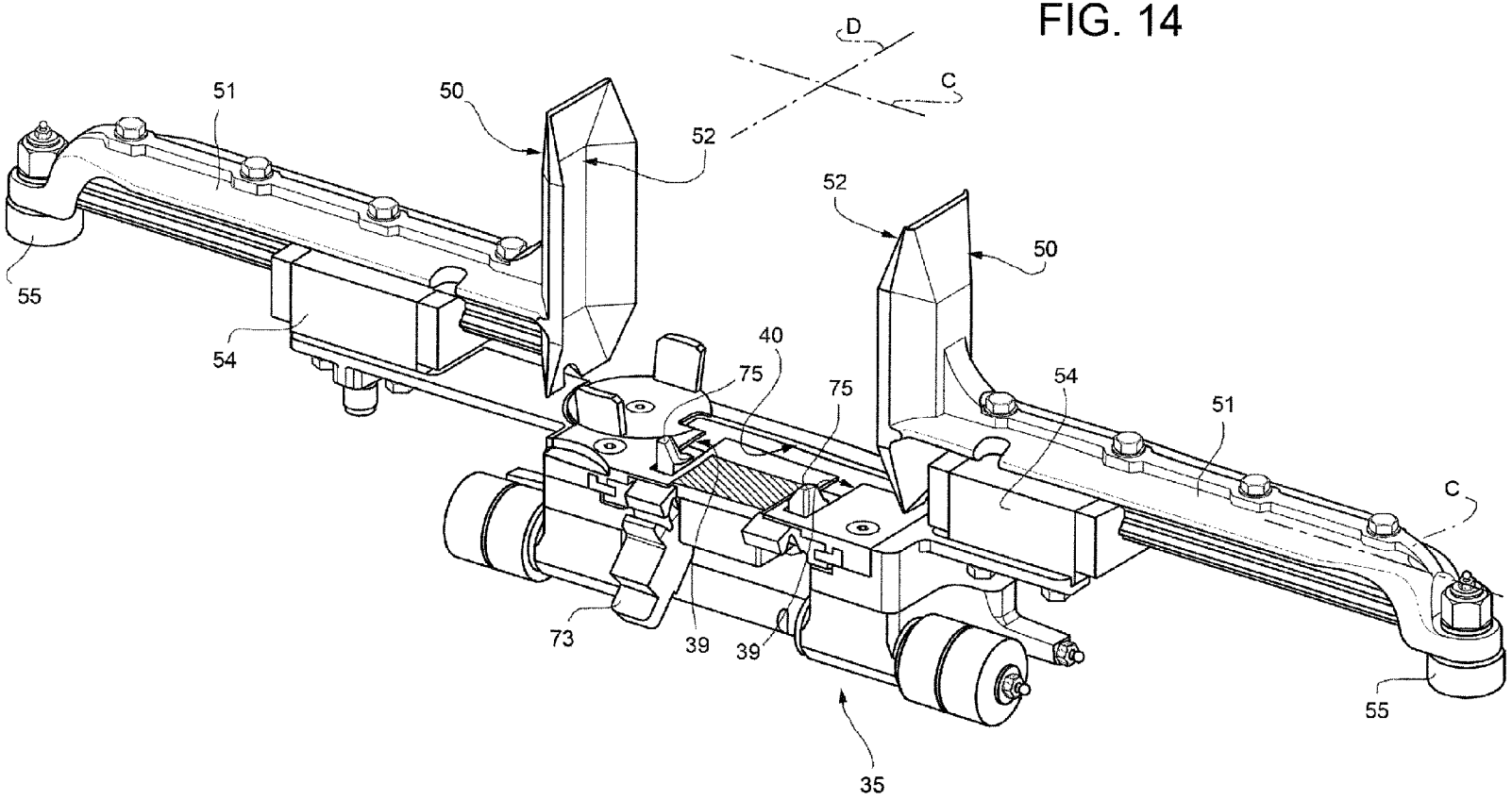

Link 35 comprises (FIGS. 12 to 14):

plate 36;

paddle 43;

a pair of shells 50 which may move relative to paddle 43 along direction C;

a pair of arms 51 connected to relative shells 50, elongated parallel to direction C and comprising each a relative slide 53; and a pair of guides 54 which extend on opposite sides of relative paddle 43 along direction C, and relative to which slides 53 move parallel to direction C.

Referring again to FIGS. 1 and 2, plate 36 is arranged below, and then supports, pack 3 (or package 2) along portion P and a starting stretch of portion Q of forming path B.

Conversely, plate 36 is arranged above package 2 along portion R of forming path B. Accordingly, folded package 2 is released, under the gravity action at station 22, to conveyor 42.

Shells 50 define, on their sides opposite to arm 51, relative surfaces 52 which are adapted to cooperate with pack 3 and which face each other.

Surfaces 52 mirror the lateral surface of packages 2 to be folded, so as to control the final shape of packages 2.

In the embodiment shown, each surface 52 mirrors a relative walls 10*b* and parts of relative walls 11.

Each arm 51 comprises, on its end opposite to relative shell 50, a roller 55.

Each slide 53 is arranged between relative shells 50 and rollers 55 of relative arm 51. Furthermore, each slide 53 may slide parallel to direction C relative to guide 54.

In the embodiment shown, each arm 51 is integral with relative shell 50.

Paddles 43 mirror the shape of walls 10 and of the part of relative walls 11 they cooperate with.

Plate 36 of link 35 comprises (FIGS. 12 and 13):

a rectangular portion 37 from which paddle 43 protrudes; and a contoured portion 38 which surrounds portion 37.

Plate 36 of link 35 also defines:

a pair of through slots 39 which are arranged on opposite lateral sides of paddle 43 and elongated along a direction D tangent to forming path B and orthogonal to direction C;

a through slot 40 which is in communication with slots 39, is arranged downstream from slots 39 and portion 37 proceeding according to the advancing direction of chain 60, and which extends parallel to direction C.

Slots 39 are arranged on lateral sides of portion 37 and slots 39, 40 are defined between portions 37, 38.

Slots 39 extend, along direction D, between slot 40 and relative bridges 47 which integrally connect portions 36, 37.

Slots 40 is elongated parallel to direction C.

Folding means 24 advantageously comprises, for each link 35:

plate 36 which is integrally movable with paddle 43 along forming path B; and a C-shaped movable plate 72 which may move along direction D relative to paddle 43 and plate 36 between a first position (FIG. 12) in which it engages slot 40, so as to fold end fin 18 housed therein, and a second position (FIG. 13) in which it leaves free slot 40.

In particular, slot 40 remains open when plate 72 is in the second position.

Link 35 also comprises a pair of toothed sectors 73 staggered along relative direction C and which protrude from link 35 downstream from plate 36, proceeding according to the advancing direction of chain 60.

Figure 12:
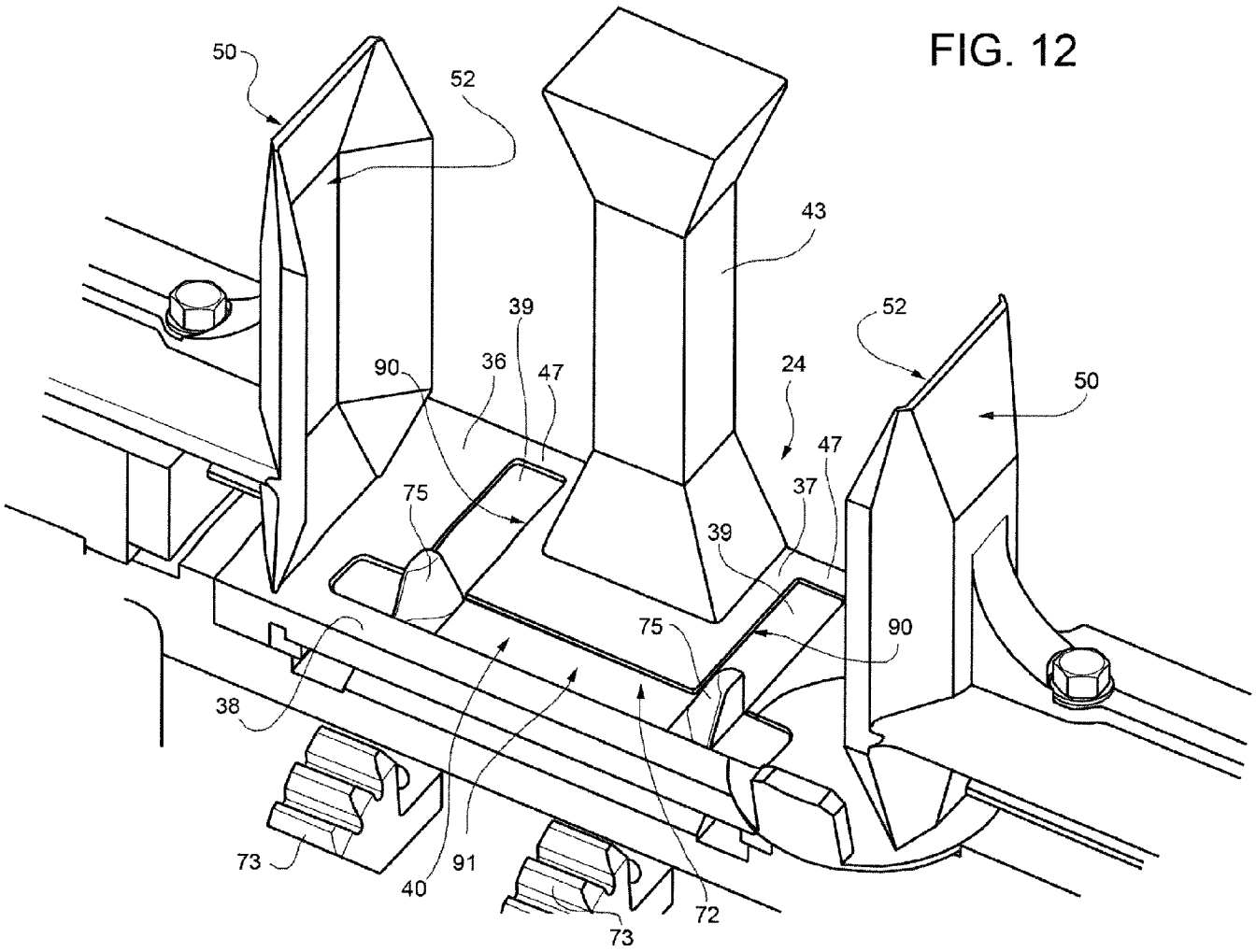

Plate 72 integrally comprises two arms 90 arranged on lateral sides of paddle 43, and a central element 91 interposed between arms 90 (FIG. 12).

Each arm 90 comprises a wedge 75 arranged on the side of paddle 43 and a rack 76 (FIG. 11) arranged on the side of cam 26 and gear 25.

Element 91 is housed within slot 40 when plate 72 is in the first position, and is arranged upstream from slot when plate 72 is in the second position.

In the embodiment shown, wedges 75 are triangular in cross section and converge towards a mid-direction of link 35.

Wedges 75 are arranged downstream from racks 76, proceeding according to an advancing direction of chain 34.

Figure 11:
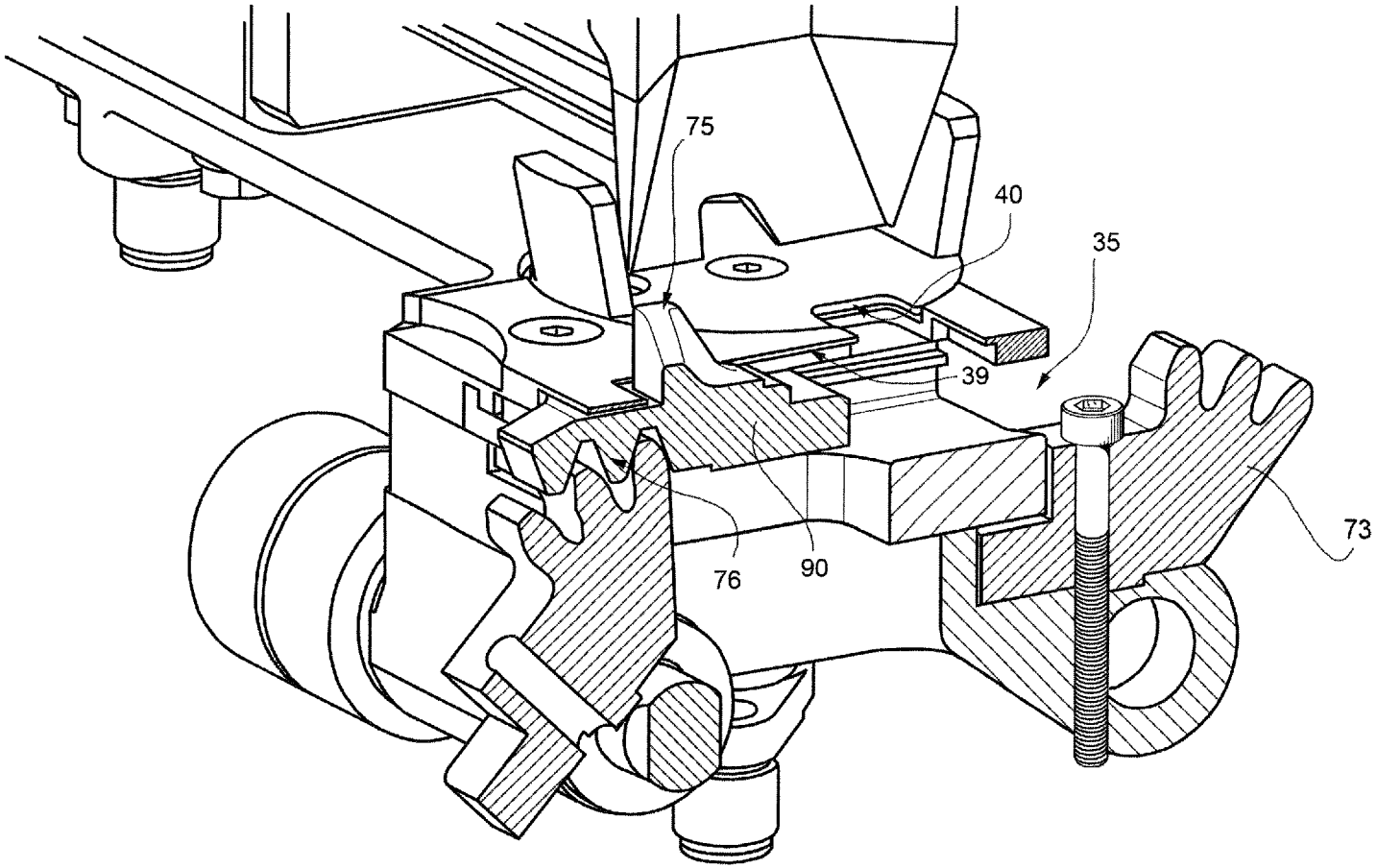
FIGS. 11 to 14 are perspective views of further components of the folding unit of FIGS. 1 to 5.

Toothed sectors 73 of each link 35 mesh with racks 76 of the following link 35, proceeding along the advancing direction of chain 60 (FIG. 11).

Plate 72 is arranged in the second position at station 21, moves from the second to the first position along stretch P1 of path B, remains in the first position along stretch P2 of path B, moves from the first to the second position along portion Q of path B, and remains in the second position along portion R of path B and from station 22 to station 21.

More precisely, fin 18 of pack 3 is arranged within open slot 40 of link 35 at station 21. When plate 72 of link 35 moves in the first position and engages slot 40, fin 18 is folded onto end portion 8. At the same time, wedges 75 raise flaps 20 towards end portion 8 and bend flaps 20 relative to axis A, up to when they reach the position shown in FIG. 8.

The corresponding shells 50, as moving from the open to the fully closed position, press flaps 20 against top stretches 14 of relative walls 12, downstream from folding means 23 and heating device 17, proceeding according to the advancing direction of chain 60.

Unit 1 also comprises a pair of cams 61 (FIGS. 3 and 4) adapted to control the movement of each pair of shells 50 between relative fully closed, closed position and open position, as each pair of shells 50 advances along path B.

Furthermore, cams 61 also control the movement of each pair of shells 50 integrally to each other along direction C and relative to paddle 43 of corresponding link 35.

In detail, cams 61 are arranged on opposite lateral sides of chain 60.

One cam 61 comprises a groove 62 which is engaged by rollers 55 of first shells 50.

The other cam 61 comprises a further groove 62 which is engaged by rollers 55 of second shells 50.

Figure 3:
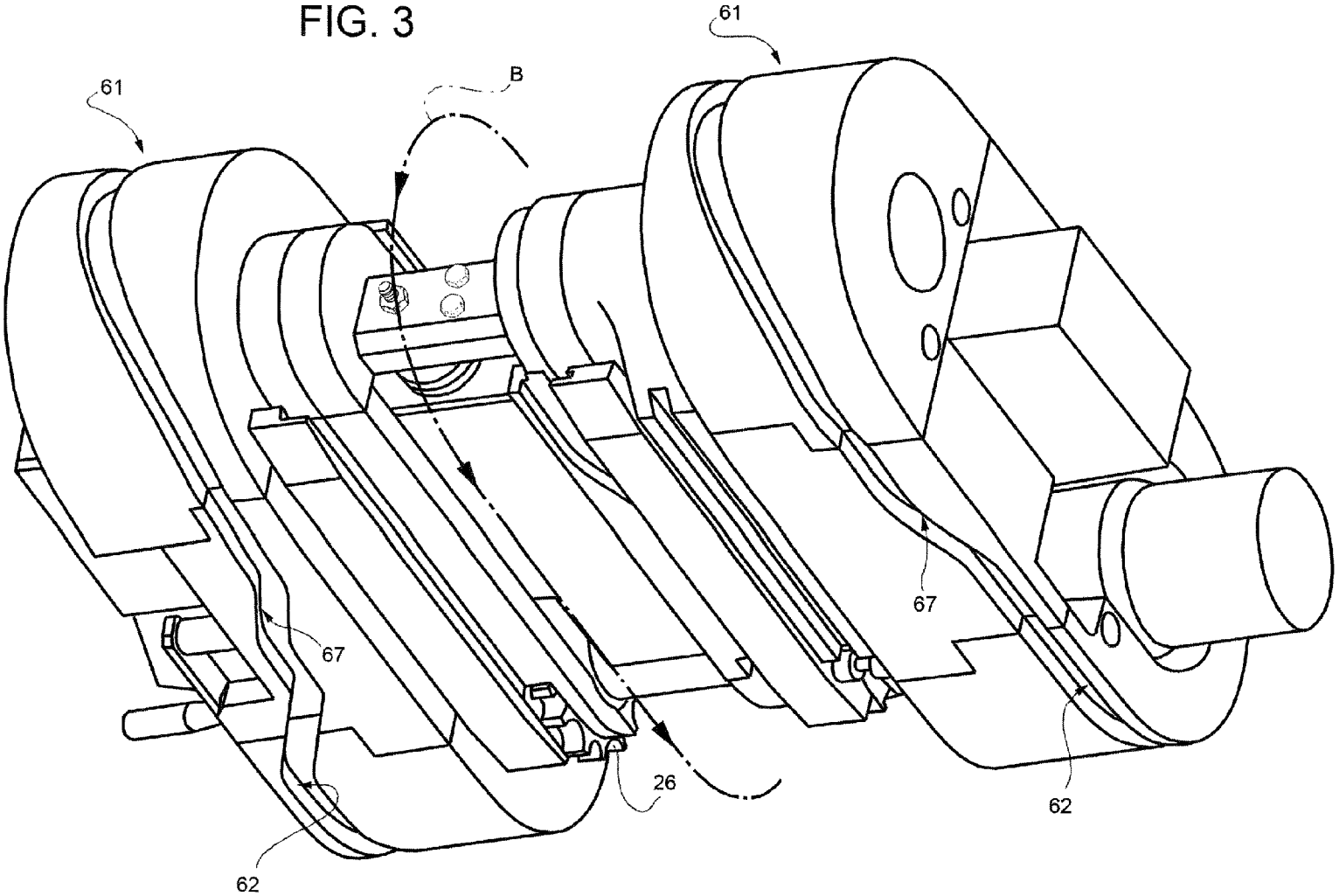
FIGS. 3 and 4 show respectively bottom and top perspective views, with parts removed for clarity, of the folding unit of FIG. 2.
Figure 4:
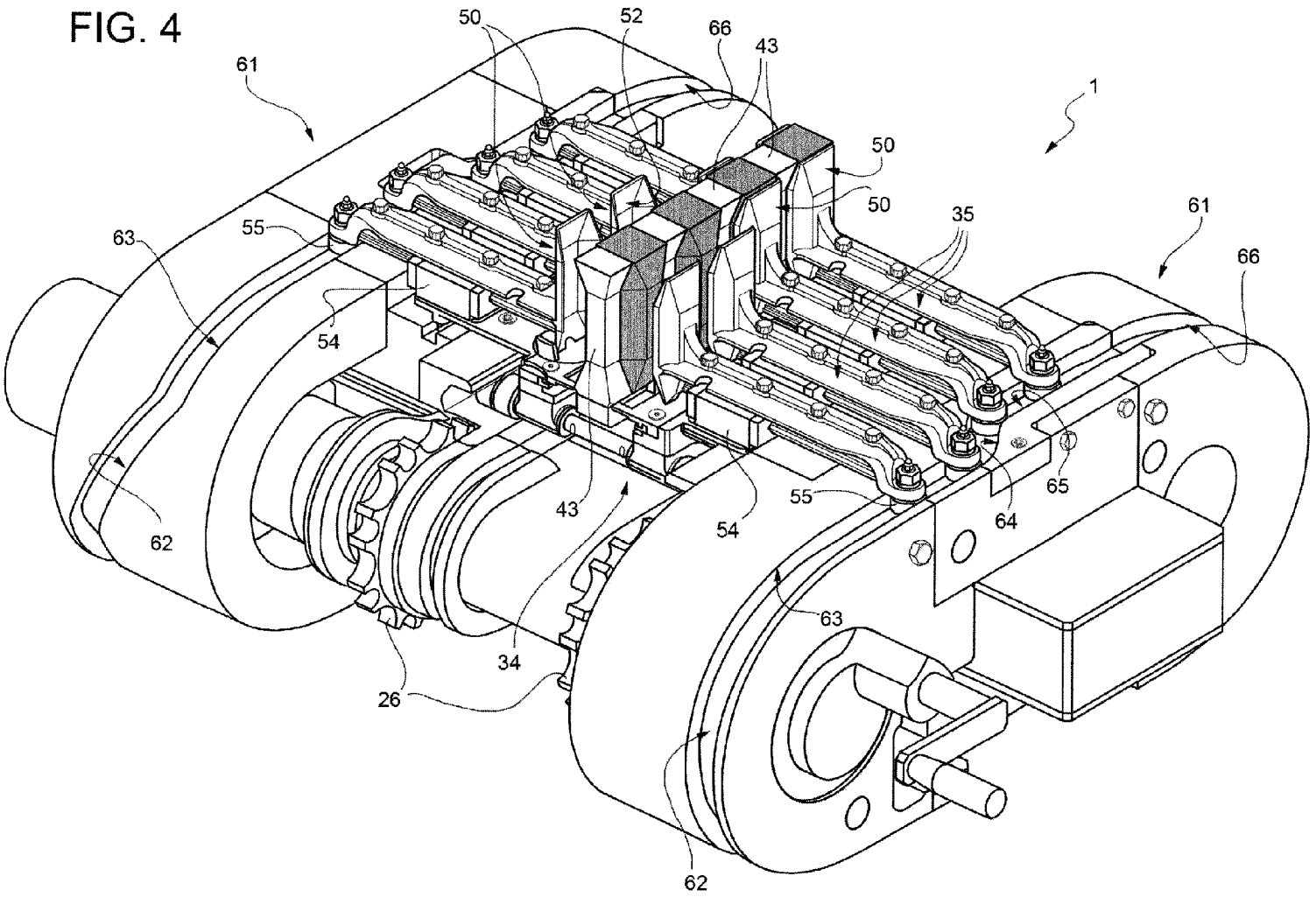
Figure 5:
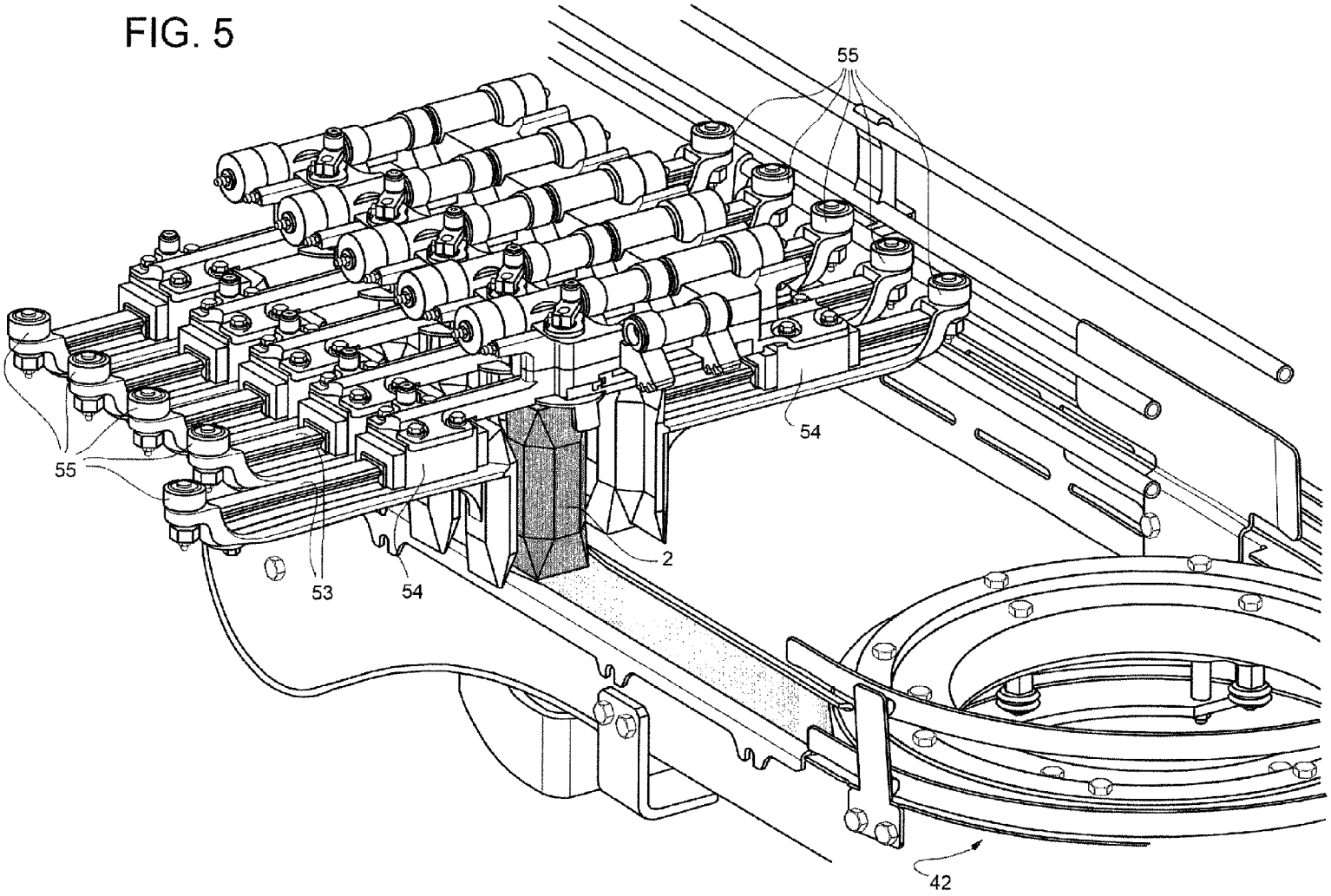
FIG. 5 shows a perspective view, with parts removed for clarity, of the bottom part of the folding unit of FIGS. 1 to 4.

With reference to FIGS. 3 to 5, grooves 62 comprise, proceeding from station 21 to station 22:

- relative straight portions 63 which are adapted to keep shells 50 of each pair in the open position;
- relative converging portions 64 which are adapted to move shells 50 from relative open to relative fully closed portion along stretch P2 of path P;
- relative straight portions 65 which are adapted to keep shells 50 of each pair in respective fully closed position;
- relative curved portions 66 which are adapted to move shells 50 from respective fully closed to respective closed positions; relative curved portions 66 are also adapted to integrally move shells 50 with respect to paddle 43 and parallel to respective directions C; and
- relative curved portions 67 which are adapted to move shells 50 from respective closed to respective open positions.

Folding means 23 comprise a guide member 45 fitted in a fixed position between station 21 and heating device 27 (FIG. 1).

Guide member 45 defines a contrast surface 46 (FIG. 1) converging towards chain 60 and cooperating in a sliding manner with end portion 9 of each pack 3 to compress and flatten end portion 9 towards chain 60.

Frame 29 also comprises a pair of fixed sides 68 (only one shown in FIG. 1) for laterally containing packs 3 along path B, located on opposite sides of chain 60, and extending between station 21 and heating device 27.

Heating device 27 comprises (FIGS. 1, 8 and 9):

- an assembly air device 69 fitted to frame 29;
- a pair of first nozzles 70 connected to assembly 69 and adapted to direct hot air onto flaps 20 of each pack 3 before each pack 3 reaches final pressing device 28; and
- a pair of second nozzles 71 connected to assembly 69 and adapted to direct hot air onto flaps 20 of each pack 3 before a relative pair of shells 50 reaches the fully closed position.

Pressure device 28 comprises (FIG. 1) a belt 80 wound onto a drive wheel 81 and a driven wheel 82. Belt 80 comprises, on its outer surface opposite to wheels 81, 82, a plurality of projections 83 which are adapted to press flaps 19 of each pack 3 onto relative fin 17.

The volume of each package 2 in formation is controlled, downstream from heating device 27, within a compartment bounded by:

- paddles 43 of relative link 35 and of the link 35 arranged immediately downstream proceeding according to the advancing direction of chain 60;
- shells 50 of relative link 35 which are arranged in the fully closed position;
- plate 72 of relative link 35 arranged in the second position; and
- belt 80.

Operation of unit 1 will be described with reference to one pack 3 and to relative link 35 as of an initial instant, in which pack 3 is fed from the in-feed conveyor to chain 60 at station 21 of path B.

In this condition, link 35 is moving at the beginning of stretch P1 and therefore slot 40 is open. Furthermore, shells 50 are arranged into the open position.

In detail, pack 3 is positioned with end fin 18 facing plate 72 of link 35, and slides on one wall 10*a* along relative paddle 43, so that fin 18 is parallel to paddle 43, until when fin 18 enters open slot 40.

In this condition, pack 3 is arranged above and, therefore, supported by plate 36 of link 35.

As link 35 moves along stretch P1 and a portion of stretch P2, contrast surface 46 cooperates in a sliding manner with end portion 8 of pack 3. In this way, portions 8 and 9 are flattened towards each other, fin 17 is folded onto portion 8 and flaps 20 are bent relative to portion 8 towards axis A and on the opposite side of portion 8, as shown in FIG. 9.

At the same time, each pair of consecutive links 35 moves towards each other along stretch P1. In this way, racks 76 of the subsequent link 35 are thrust by toothed sectors 73 of the precedent link 35, proceeding according to the advancing direction of chain 60 along stretch P1 of forming path B.

Accordingly, plate 72 of the subsequent link 35 moves from the second position to the first position, in which it engages slot 40.

As plate 72 engages slot 40, fin 18 is folded onto end portion 9. Simultaneously, wedges 75 raise flaps 20 towards end portion 8 and bend flaps 20 relative to axis A, as shown in FIGS. 8 and 9.

As link 35 moves along stretch P2, shells 50 move from the open position to the fully closed position and plate 72 is arranged in the first position.

Before shells 50 reach pack 3, nozzles 70, 71 direct air onto flaps 19, 20 of pack 3, to partly and locally melt the packaging material of flaps 19, 20 (FIG. 9).

Immediately after, shells 50 contact walls 10*b*, 11 of packs 3, and press flaps 20 onto relative top stretches 14 of walls 11 as flaps 20 cool. In this condition, shells 50 are arranged in the fully closed position.

Subsequently, pack 3 is arranged below belt 80 and projections 83 press flaps 20 onto portion 9, as flaps 20 cool.

In this condition, the volume of folded package is controlled by two paddles 43 of respective consecutive links 35, by shells 50 arranged in the fully closed position, and by projections 83 of belt 80.

Folded package 2 then move along portion Q of path P.

Along portion Q, shells 50 move relative to each other from the fully closed to the closed position, in which they grip package 2 but substantially do not exert any pressure thereon.

Furthermore, shells 50 move together with package 2 relative to paddle 43 parallel to direction C, along portion Q.

In this way, shells 50 together with folded package 2 are staggered from paddle 43, at the end of portion Q.

Along portion Q, each pair of consecutive links 35 move away from each other. In this way, racks 76 of the subsequent link 35 move away from toothed sectors 73 of the precedent link 35.

Accordingly, plate 72 of the subsequent link 35 moves back from the first to the second position, in which it leaves free slot 40.

Finally, folded package 2 and shells 50 arranged in the closed position are conveyed along portion R.

It is important to mention that during the descending stretch of portion Q and along portion R of path B, folded package 2 is arranged below plate 36 and is supported by the shells 50 arranged in the closed position.

At station 22, shells 50 move back to the open position and package 2 is released, under the gravity action, to the out-feed conveyor.

Being staggered relative to shells 50 and package 2, paddle 43 does not interfere with the release of package 2.

Subsequently, shells 50 are conveyed by chain 60 towards station 21.

The advantages of unit 1 according to the present invention will be clear from the foregoing description.

In particular, the whole fin 18 of each pack 3 is folded on end portion 9, by simply moving plate 72 from the second to the first position.

As a result of this single and very simple movement, the bending of the fin 18 is particularly precise and highly repeatable.

Furthermore, when plates 72 are in the respective second positions, wedges 75 raise flaps 20 towards end portion 8 without putting flaps 20 in contact with stretches 14 of walls 10*b*.

In this way, it is possible to make use of shells 50 movable along relative directions C may be used for:

both completing the bending of flaps 20 onto top stretches 14 of relative walls 10*a*; and for subsequently pressing flaps 20 onto relative walls 10*b*.

Accordingly, due to the presence of wedges 75, the forming of packages 2 may be controlled both using shells 50 having a shape associated to the final design of packages 2.

As a result, the forming of packages 2 is highly precise and repeatable, even when package 2 has a round or polygonal cross-section.

Clearly, changes may be made to unit 1 without, however, departing from the protective scope defined in the accompanying Claims.

Unit 1 could comprise only one cam 61.

The invention claimed is:

1. A folding unit for producing packages of pourable food products from sealed packs having each a main portion and opposite end portions arranged on opposite sides of said main portion; each pack comprising, for each end portion, a fin and a pair of flaps projecting laterally from said main portion;

said unit comprising:

a first movable conveying member which is fed with a plurality of said packs and which feeds the pack along a forming path; and folding means which interact with each said pack along said forming path to fold relative said end fin onto a relative said end portion;

wherein said folding means include:

a first member movable along said forming path together with said conveying member and defining a first slot receiving, in use, said end fin; and a second member linearly slidable along the forming path relative to said first member between a first position in which the second member engages at least partially said slot, so as to fold said end fin onto a relative said end portion, and a second position in which the second member leaves free said slot.

2. The folding unit of claim 1, wherein said second member comprises at least one first element adapted to mesh with a second element, so as to cause the movement of said second member between said first and said second position.

3. The folding unit of claim 2, wherein said at least one first element is a rack and said second element is a toothed sector.

4. The folding unit of claim 2, wherein said second member comprises at least one wedge adapted to raise, in use, relative said flaps towards said main portion.

5. The folding unit of claim 4, wherein said wedge is arranged on a first side of said second member and said first element is arranged on a second side, opposite to said first side, of said member.

6. The folding unit of claim 4, wherein said wedge is arranged downstream from said first element, proceeding according to the advancing direction of said conveying member.

7. The folding unit of claim 2, wherein said second element forwardly protrudes from said conveying member, proceeding according said advancing direction of said conveying member.

8. The folding unit of claim 1, wherein each conveying member includes a paddle adapted to thrust said pack along said forming path;

said first member including a portion from which said paddle protrudes and said slot being arranged downstream from said portion, proceeding according said advancing direction of said conveying member; and said second member including, for each side of said first member, one wedge and one rack.

9. The folding unit of claim 8, wherein said first member defines a pair of second slots connected to said first slot;

said second member including a pair of arms movable within relative said second slots and a central element interposed between said arms; said central element engaging said slot when said second member is arranged, in use, in said first position.

10. The folding unit of claim 9, wherein each said arm includes a relative said wedge and a relative rack.

11. The folding unit of claim 1, including a plurality of said conveying members defining a closed loop;

each said conveying member comprising a first element and a second toothed element;

said second toothed element of each said upstream conveying member meshing with said first element of the immediately downstream conveying member.

12. The folding unit of claim 11, wherein said forming path is a closed loop path comprising:

a first curved portion along which each said conveying member is fed, in use, with a relative said pack to fold, and along which each pair of consecutive conveying members move towards each to each other; and a second rectilinear portion arranged downstream from an inlet portion along which each pair of consecutive said conveying members move substantially integrally to each other;

said second member moving, in use, from said second position towards said first position along said first curved portion;

said second member being arranged, in use, in said first position along said second rectilinear portion.

13. The folding unit of claim 12, wherein said forming path comprises also a second curved portion arranged downstream from said rectilinear portion proceeding along said advancing direction of said conveying members, and along which said conveying members move, in use, away from to each other; said conveying members moving from first to said second position, along said second curved portion.

14. A folding unit for producing packages of pourable food products from sealed packs each possessing a main portion and first and second end portions arranged on opposite sides of the main portion, the sealed packs comprising a first end fin and a first pair of flaps projecting laterally from the main portion at the first end portion, the sealed packs comprising a second end fin and a second pair of flaps projecting laterally from the main portion at the second end portion, the folding unit comprising:

a conveying member configured to receive each of the packs and convey the packs along a forming path in a conveying direction; and a folding means which interacts with each the pack moving along the forming path to fold the first end fin onto the first end portion;

the folding means comprising:

a first member movable along the forming path together with the conveying member, the first member comprising a first slot configured to receive the first end fin;

a second member movable in the conveying direction relative to the first member between a first position in which the second member at least partially engages the slot to fold the first end fin onto the first end portion, and a second position in which the second member is removed from the slot of the first member; and an entirety of the second member being movable in the conveying direction relative to the first member.

15. The folding unit of claim 14, wherein the second member comprises at least one first element configured to mesh with a second element to cause the movement of the second member between the first and the second position.

16. The folding unit of claim 15, wherein the at least one first element is a rack and the second element is a toothed sector.

17. The folding unit of claim 15, wherein the second member comprises at least one wedge configured, in use, to raise the flaps towards the main portion.

18. The folding unit of claim 17, wherein the wedge is arranged on a first side of the second member and the first element is arranged on a second side of the member, the second side of the member being opposite to the first side, of the member.

19. The folding unit of claim 17, wherein the wedge is arranged downstream from the first element considered with reference to the advancing direction of the conveying member.

* * * * *